US010781007B2

(12) United States Patent
Seesing

(10) Patent No.: US 10,781,007 B2
(45) Date of Patent: Sep. 22, 2020

(54) HANDHELD TOOL FOR INSTALLING WIRE ON A FENCE

(71) Applicant: Anthony P. Seesing, Billings, MT (US)

(72) Inventor: Anthony P. Seesing, Billings, MT (US)

( * ) Notice: Subject to any disclaimer, the term of this patent is extended or adjusted under 35 U.S.C. 154(b) by 146 days.

(21) Appl. No.: 16/147,799

(22) Filed: Sep. 30, 2018

(65) Prior Publication Data

US 2020/0102105 A1 Apr. 2, 2020

(51) Int. Cl.

| | |
|---|---|
| ***B25B 27/00*** | (2006.01) |
| ***B65B 13/28*** | (2006.01) |
| ***E04G 21/12*** | (2006.01) |
| ***B25B 31/00*** | (2006.01) |
| ***B21F 33/02*** | (2006.01) |
| *B21F 15/04* | (2006.01) |
| *B21F 15/06* | (2006.01) |
| *B25B 27/14* | (2006.01) |
| *E04C 5/16* | (2006.01) |

(52) U.S. Cl.

CPC ..... *B65B 13/285* (2013.01); *B21F 33/02* (2013.01); *B25B 31/00* (2013.01); *E04G 21/123* (2013.01); *B21F 15/04* (2013.01); *B21F 15/06* (2013.01); *B25B 27/146* (2013.01); *E04C 5/167* (2013.01)

(58) Field of Classification Search

CPC ..... E04H 17/266; E04H 17/268; B21F 9/00; B21F 7/00; B21F 27/08; B21F 27/14; B21F 29/00; B21F 29/02; B21F 33/02

USPC ..... 140/93.6, 118, 113, 93 D; 74/45, 47, 49

See application file for complete search history.

(56) References Cited

U.S. PATENT DOCUMENTS

| | | | | |
|---|---|---|---|---|
| 356,638 | A | 1/1887 | Haag | |
| 595,623 | A | 12/1897 | Guthrie | |
| 900,099 | A * | 10/1908 | Hurd | B21J 15/32 29/816 |
| 920,737 | A | 5/1909 | Hardy | |
| 2,765,003 | A * | 10/1956 | Willis | B65H 69/068 140/93 R |
| 3,031,170 | A | 4/1962 | Ingram | |
| 3,722,553 | A * | 3/1973 | Bartilson | B21F 7/00 140/93 A |
| 5,606,181 | A | 2/1997 | Vuong | |
| 6,044,872 | A | 4/2000 | Stephens | |
| 7,290,570 | B1 * | 11/2007 | Spikes | B21F 7/00 140/118 |
| 8,407,875 | B2 | 4/2013 | Gray et al. | |
| 9,194,079 | B2 | 11/2015 | Kudou et al. | |

(Continued)

*Primary Examiner* — Adam J Eiseman
*Assistant Examiner* — Dylan Schommer
(74) *Attorney, Agent, or Firm* — Antoinette M. Tease

(57) ABSTRACT

A handheld tool for installing wire on a fence, the tool having a frame, a sprocket system that is situated at least partially within the frame and engaged by an actuator, a T-post alignment unit that is configured to position a vertical T-post against the tool, a clip storage magazine that is attached to a top of the frame, a tube assembly that is movably mounted within the frame, and a presenter that is configured to present clips from the magazine. The sprocket system and tube assembly are configured to cause the clip presented by the presenter to be pushed into position against the T-post and a horizontal fence wire, tension the fence wire against the T-post, lock the fence wire into position against the T-post by straddling the T-post with the clip, and wrap two ends of the clip around the fence wire to attach it to the T-post.

6 Claims, 9 Drawing Sheets

(56) References Cited

U.S. PATENT DOCUMENTS

| | | | |
|---|---|---|---|
| 9,797,148 | B2 | 10/2017 | Kodi |
| 2006/0243340 | A1 | 11/2006 | Wheeler et al. |
| 2009/0314379 | A1 | 12/2009 | Gray et al. |
| 2014/0298770 | A1 | 10/2014 | Kudou et al. |
| 2016/0069096 | A1 | 3/2016 | Kodi |

* cited by examiner 1
2
3
4
5
6
7
8
9
10
11
12
13
14
14
15
15
16
17
18
19
20
21
22
23
25
26
27
28
29
30
31
32
33

HANDHELD TOOL FOR INSTALLING WIRE ON A FENCE

BACKGROUND OF THE INVENTION

1. Field of the Invention

The present invention relates to the field of handheld devices used to assemble and repair wire fences, and more particularly, to devices that attach horizontal fence wires to vertical metal T-posts using wraparound wire clips.

2. Description of the Related Art

The present invention utilizes a combination of linear and rotary motions of its components to strip a single clip off a stack of clips stored within the present invention, push the clip into position against a vertical T-post and a horizontal fence wire, tension the fence wire against the T-post, lock the fence wire into position against the T-post by straddling the T-post with the clip, and wrap the two ends of the clip around the fence wire to attach the fence wire to the T-post. There are number of inventions that are the subject of issued patents and patent applications that are designed to attach fence wires to fence posts, but none of these inventions incorporates the novel features of the present invention.

U.S. Pat. No. 356,638 (Haag, 1887) discloses a hand-crank operated machine for attaching horizontal fence wires to vertical pickets. With this invention, a single wrapping wire (aka clip) is manually installed into the invention so that each end of the clip is inserted into a hole in a respective pinion gear. When the invention is placed against a fence wire and adjacent picket, and the hand crank is operated, the pinion gears are caused to rotate, thereby wrapping the ends of the clip around the fence wire on each side of the picket.

U.S. Pat. No. 595,623 (Guthrie, 1897) discloses a hand-crank operated machine for attaching fence wires to pickets. As in the Haag invention described above, in the Guthrie invention a single wrapping wire (aka clip) is manually installed into the invention so that each end of the clip is inserted into a hole in a respective pinion gear. When the invention is placed against a fence wire and adjacent picket and the hand crank is operated, the pinion gears are caused to rotate, thereby wrapping the ends of the clip around the fence wire on each side of the picket. The Hardy invention incorporates components that allow the width of the invention to be adjusted in order to fit around pickets of various widths, and it incorporates multiple holes in each pinion gear to allow the use of various sizes of clips for use with various widths and thicknesses of pickets. The crank handle of the Hardy invention may be attached to either end of the crank shaft, enabling the invention to be operated by either the right or left hand of the operator.

U.S. Pat. No. 920,737 (Hardy, 1909) discloses an apparatus for attaching vertical stay-wires to horizontal fence wires. This invention incorporates two separate rolls of stay-wire material that are sequentially wrapped around successive strands of the horizontal fencing wires, from top to bottom of the fence, and trimmed from the roll after wrapping around the bottom fencing wire, thereby forming a pair of vertical wire stay-wires at fixed a fixed separation distance from each other along the fence. The purpose of the stay-wires is to maintain a fixed separation distance between adjacent strands of the horizontal fence wire. The invention comprises a hand-operated crank. Unlike the present invention, the Hardy invention is not designed to attach horizontal fence wires to vertical posts.

U.S. Pat. No. 3,031,170 (Ingram, 1962) discloses a device for attaching fence wires to fence posts by applying bendable wire clips around the fence wires and fence posts. The invention comprises a spring-loaded magazine unit that is capable of holding a plurality of wire clips, and a pusher unit that is capable of removing the wire clips individually from the magazine and holding them against a fence T-post. The invention does not incorporate a crank or gears to wind the ends of a wire clip around a fence wire, but instead, the entire invention is rotated around the fence wire to wind the wire clip around the fence wire, with the handle providing the required leverage to bend the wire clips.

U.S. Pat. No. 5,605,181 (Vuong, 1997) discloses a handheld wire twisting apparatus that is designed to twist together a plurality of electrical wires whose ends may be attached together. The invention incorporates a locking ratchet mechanism that prevents untwisting of the wires during the twisting process. The invention does not involve the use of wire clips to attach wires to posts.

U.S. Pat. No. 6,044,872 (Stephens, 2000) discloses a fence clip installation tool. The device utilizes a plurality of pre-shaped and pre-loaded wire clips to attach fence to fence posts. The invention utilizes a first lever handle to push a wire clip against a fence post and around a wire strand, and a second lever handle to bend the ends of the wire clip around the wire strand to form the attachment. Unlike the present invention, the Stephens invention does not comprise a crank handle or gears.

U.S. Pat. No. 7,290,570 (Spikes, 2007) discloses a fence wire attachment device that attaches fence wires to fence posts using attachment wires that are looped around the fence post and twisted around the fence wire in the conventional manner. The invention is capable of being loaded only with a single wire clip. The ends of the wire clip are inserted into transverse holes which are installed through a pair of twisting gears within the invention. Twisting force to install the wire clip around the fence wire is provided by a removable external machine such as an electric drill or hand drill.

U.S. Pat. No. 8,407,875 (Grey et al., 2013) discloses a tool for fastening fence wires to a fence post using preloaded staples that are bent around the fence post. Unlike the present invention, the Grey invention utilizes a crimping action rather than a twisting or winding action that attaches the staple around a fence post such as a metal T-post while also encircling a fence wire and holding it against the T-post.

U.S. Pat. No. 9,194,079 (Kudou, et al., 2015) discloses a device and method for attaching two wires end-to-end by twisting. This invention is not suitable for attaching fence wires to fence posts.

U.S. Pat. No. 9,797,148 (Kodi, 2017) discloses a device for attaching reinforcing bars together with plastic clips. The clips used in this invention are flexible, and are snapped around pipes rather than being wrapped around wires as in the present invention.

U.S. Patent Application Pub. No. 2006/0243340 (Wheeler et al., 2006) discloses a pliers-type device comprising a pair of operating handles, The invention is designed to attach fence wires to fence posts by bending a staple around the two objects. This invention does not provide for winding of an attachment clip around a fence wire as a method of attachment.

U.S. Patent Application Pub. No. 2009/0314379 (Gray et al., 2009) discloses a pliers-type device designed to attach fence wires to fence posts by bending staples around the two objects. The invention is similar to that described in Gray et al. (Pub. No. 2009/0314379).

BRIEF SUMMARY OF THE INVENTION

The present invention is a handheld tool for installing wire on a fence comprising: a frame having a horizontal bottom, a first vertical side, and a second vertical side; a sprocket system that is situated at least partially within the frame and engaged by an actuator; a T-post alignment unit that is configured to position a vertical T-post against the tool; a clip storage magazine that is attached to a top of the frame and mounted with its vertical axis perpendicular to a longitudinal axis of the frame; a tube assembly that is movably mounted within the frame; and a presenter that is configured to present clips from the magazine; wherein the sprocket system and tube assembly are configured to cause the clip presented by the presenter to be pushed into position against the T-post and a horizontal fence wire, tension the fence wire against the T-post, lock the fence wire into position against the T-post by straddling the T-post with the clip, and wrap two ends of the clip around the fence wire to attach it to the T-post.

In a preferred embodiment, the sprocket system comprises a first sprocket shaft that is positioned within the frame in a direction that is perpendicular to and extends through the first and second vertical sides of the frame; wherein the first sprocket shaft is mechanically coupled to a first drive sprocket; wherein the first drive sprocket is rotatably connected to a second drive sprocket via a drive chain; wherein the second drive sprocket is mechanically coupled to a second sprocket shaft; wherein the sprocket system further comprises a first right gear, a second right gear, a third right gear, and a fourth right gear that are rotatably attached to the first vertical side of the frame; wherein each of the first right gear, second right gear, third right gear and fourth right gear comprises a head that is positioned against and parallel to an interior surface of the first vertical side of the frame; wherein the fourth right gear comprises a radial slot that extends from a perimeter of the fourth right gear to a point at or slightly beyond a centerline of the head of the fourth right gear; wherein the sprocket system further comprises a first left gear, a second left gear, a third left gear, and a fourth left gear that are rotatably attached to the second vertical side of the frame; wherein each of the first left gear, second left gear, third left gear and fourth left gear comprises a head that is positioned against and parallel to an interior surface of the second vertical side of the frame; wherein the fourth left gear comprises a radial slot that extends from a perimeter of the fourth left gear to a point at or slightly beyond a centerline of the head of the fourth left gear; wherein the first vertical side and second vertical side of the frame each comprises a horizontal slot that is installed in a forward edge of the frame; and wherein the horizontal slots in the first and second vertical sides of the frame are configured to be aligned with the radial slots in the fourth right gear and fourth left gear when the fourth right gear and fourth left gear are rotated to a particular position.

In a preferred embodiment, the fourth right gear comprises a clip winding post situated rearward of the radial slot in the fourth right gear when the radial slot of the fourth right gear is aligned with the horizontal slot in the first vertical side of the frame; wherein the clip winding post of the fourth right gear has a longitudinal axis that extends perpendicularly from a flat face of the head of the fourth right gear; wherein the fourth left gear comprises a clip winding post situated rearward of the radial slot in the fourth left gear when the radial slot of the fourth left gear is aligned with the horizontal slot in the second vertical side of the frame; and wherein the clip winding post of the fourth left gear has a longitudinal axis that extends perpendicularly from a flat face of the head of the fourth left gear. Preferably, the sprocket system further comprises a fifth right gear that is attached to the second sprocket shaft and positioned in close proximity and parallel to an interior surface of the first vertical side of the frame; wherein the fifth right gear is in mesh with the first right gear, the second right gear and the third right gear; wherein the second right gear and third right gear are in mesh with the fourth right gear; wherein the sprocket system further comprises a fifth left gear that is attached to the second sprocket shaft and positioned in close proximity and parallel to an interior surface of the second vertical side of the frame; wherein the fifth left gear is in mesh with the first left gear, the second left gear and the third left gear; and wherein the second left gear and the third left sear are in mesh with the fourth left gear.

In a preferred embodiment, a rearward end of a first left connecting rod is connected perpendicularly to a pin latch support plate; wherein the first left gear is rotatably attached to a forward end of a second left connecting rod; wherein a rearward end of the second left connecting rod is rotatably connected to a forward end of a left pivot arm, and a rearward end of the left pivot arm is rotatably connected to a left side of a tube connection plate; wherein the tube connection plate is connected to rear portions of an upper tube and a lower internal tube; and wherein a forward end of the first left connecting rod is rotatably attached to the presenter. In a preferred embodiment, a rearward end of a first right connecting rod is connected perpendicularly to the pin latch support plate; wherein the first right gear is rotatably attached to a forward end of a second right connecting rod; wherein a rearward end of the second right connecting rod is rotatably connected to a forward end of the right pivot arm; wherein a rearward end of the right pivot arm is rotatably connected to a right side of the tube connection plate; wherein the tube connection plate is connected to rear portions of the upper tube and the lower internal tube; and wherein a forward end of the first right connecting rod is rotatably attached to the presenter.

In a preferred embodiment, the tube assembly comprises: an upper tube and a lower internal tube that are fixedly attached to each other and rotationally attached to a tube connection plate; and a lower external tube into which the lower internal tube telescopically and slidably fits; wherein the pin latch support plate is fixedly connected to the lower external tube and slidably connected to the lower internal tube; wherein the pin latch support plate is rotationally connected to the presenter via a first left connecting rod and a first right connecting rod; wherein the pin latch support plate is attached to a pin latch; wherein the tube connection plate forms a mechanical connection between the upper tube and the lower internal tube; and wherein the tube connection plate is rotatably connected to a rearward end of a left pivot arm and a rearward end of a right pivot arm. Preferably, the clip storage magazine comprises a body, a top, a magazine follower and a magazine spring. Preferably, the presenter is slidably supported by a fixed clip support plate that is positioned below the presenter and attached to the first vertical side and left vertical side of the frame; and a lower end of the magazine spring is connected to a top side of the magazine follower, and an upper end of the magazine spring is in contact with the magazine top, the spring being configured to exert a downward force on a stack of clips stored in the magazine body.

In a preferred embodiment, the frame further comprises a support handle that is fixedly attached to the bottom of the frame. In one embodiment, the actuator is a manually operated crank lever. In an alternate embodiment, the actuator is a drive shaft driven by an electric motor.

BRIEF DESCRIPTION OF THE DRAWINGS

FIG. 5 B is a detail right side elevation view of the pin latch, a portion of the upper tube, and a portion of the pin latch support plate, showing the head of the pin latch after it has passed through the orifice of the upper tube, while the upper tube has reversed direction and is moving in the reverse direction, with the pin latch connected to the upper tube.

FIG. 5 C is a detail right side elevation view of the pin latch, a portion of the upper tube, and a portion of the pin latch support plate, showing the upper tube after it has reversed direction again and is moving once more in the forward direction.

FIG. 5 D is a detail right side elevation view of the pin latch, a portion of the upper tube, and a portion of the pin latch support plate, showing the upper tube once again moving in the reverse direction, after the pin latch has disconnected from the upper tube.

FIG. 6A is an isometric view a T-post and a horizontal fence wire after the fence wire has been attached to the T-post by a clip that has been installed by the present invention.

FIG. 7 C illustrates the present invention a second intermediate position of an operating cycle, with the fourth right gear rotated counterclockwise 180°.

FIG. 7 D illustrates the present invention in a third intermediate position of an operating cycle, with the fourth right gear rotated counterclockwise 270°.

FIG. 7 E illustrates the present invention in a fourth intermediate position of an operating cycle, with the fourth right gear rotated counterclockwise 360°.

FIG. 7 F illustrates the present invention in a fifth intermediate position of an operating cycle, with the fourth right gear rotated counterclockwise 450°.

FIG. 7 G illustrates the present invention in a sixth intermediate position of an operating cycle, with the fourth right gear rotated counterclockwise 540°.

FIG. 7 H illustrates the present invention in a final position of an operating cycle, with the fourth right gear rotated counterclockwise 630°.

REFERENCE NUMBERS

Figures 1, 3:
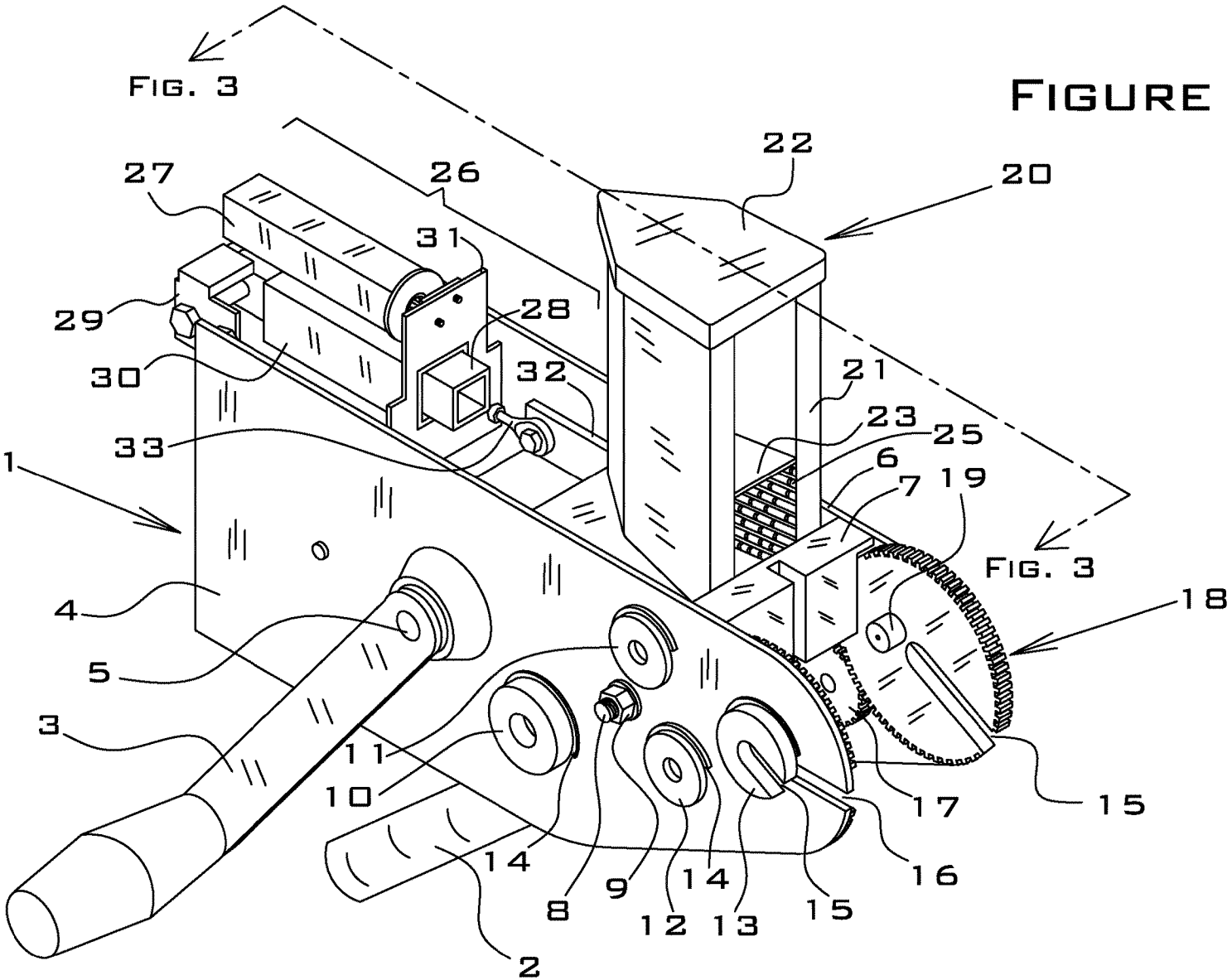
FIG. 1 is an isometric view of the present invention showing the top and right side.
FIG. 3 is a cross-section elevation view of the right side of the present invention taken at the section line shown in FIG. 1.

1 Frame
2 Support handle
3 Operating handle
4 Right side of frame
5 First sprocket shaft
6 Left side of frame
7 T-post alignment unit
8 Second sprocket shaft
9 Retaining nut
10 First right gear
11 Second right gear
12 Third right gear
13 Fourth right gear
14 Circlip
15 Radial slot
16 Horizontal slot in frame
17 Third left gear
18 Fourth left gear
19 Clip winding post
20 Clip storage magazine
21 magazine body
22 magazine top
23 Magazine follower
24 Magazine spring
25 Clip
26 Tube assembly
27 Upper tube
28 Lower internal tube
29 Tube connection plate
30 Lower external tube
31 Pin latch support plate
32 Presenter
33 First left connecting rod
34 First right connecting rod
35 T-post
36 Fence wire
37 First left gear
38 Second left gear
39 First drive sprocket
40 Drive chain
41 Second drive sprocket
43 Pin latch
44 Machine screw
45 Left pivot arm
46 Right pivot arm
46 Fifth right gear
47 Second right connecting rod
48 Clip support plate
49 Fifth left gear
50 Second left connecting rod
51 Extension tab of pin latch
52 Head of pin latch
53 Orifice
54 Interior portion of the upper tube
55 Inner wall of the upper tube
56 Coil spring of the pin latch
57 T-post protrusion

DETAILED DESCRIPTION OF INVENTION

Figure 2:
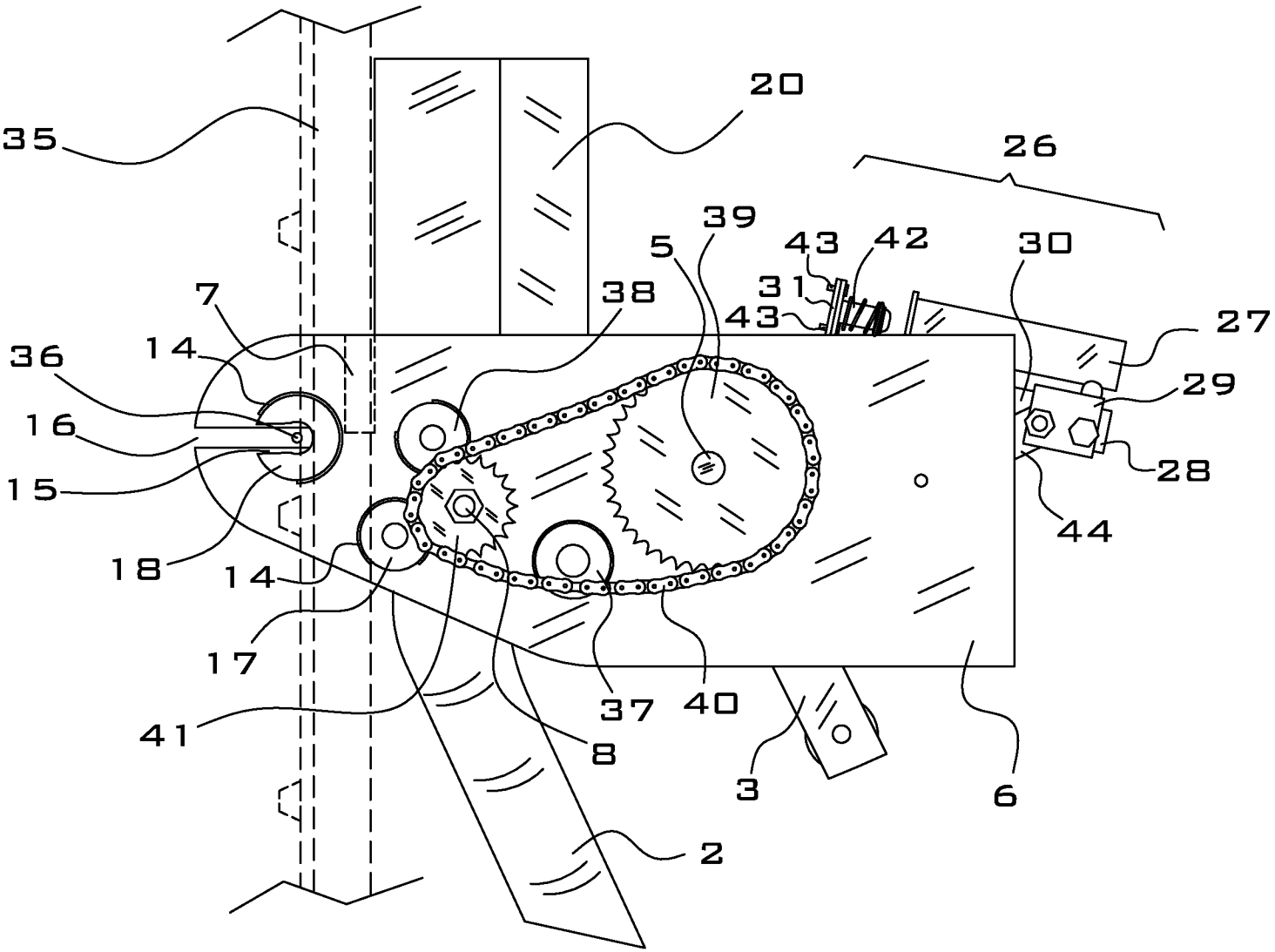
FIG. 2 is a left side elevation view of the present invention shown positioned against a T-post and a horizontal fence wire.
Figure 3:
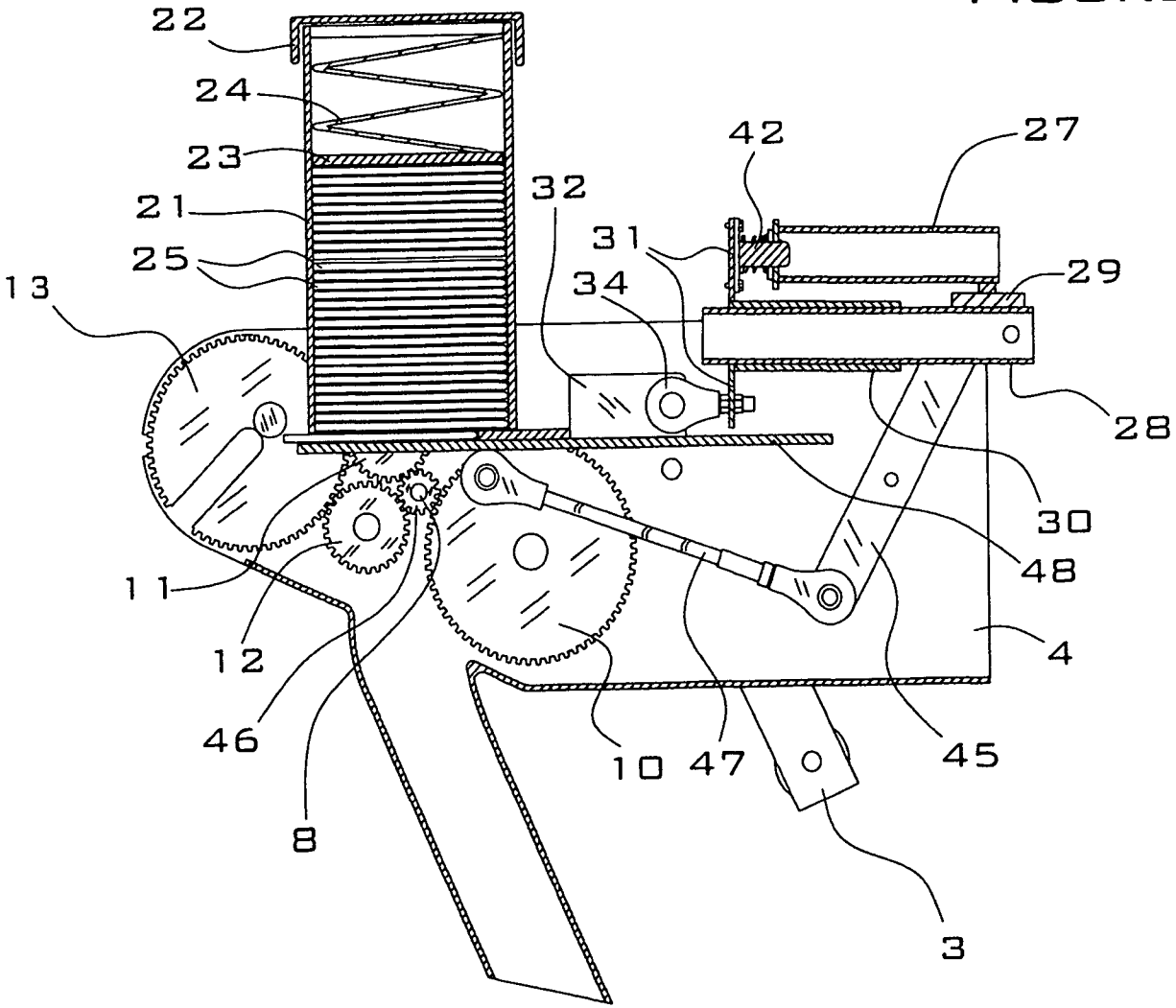
Figure 4:
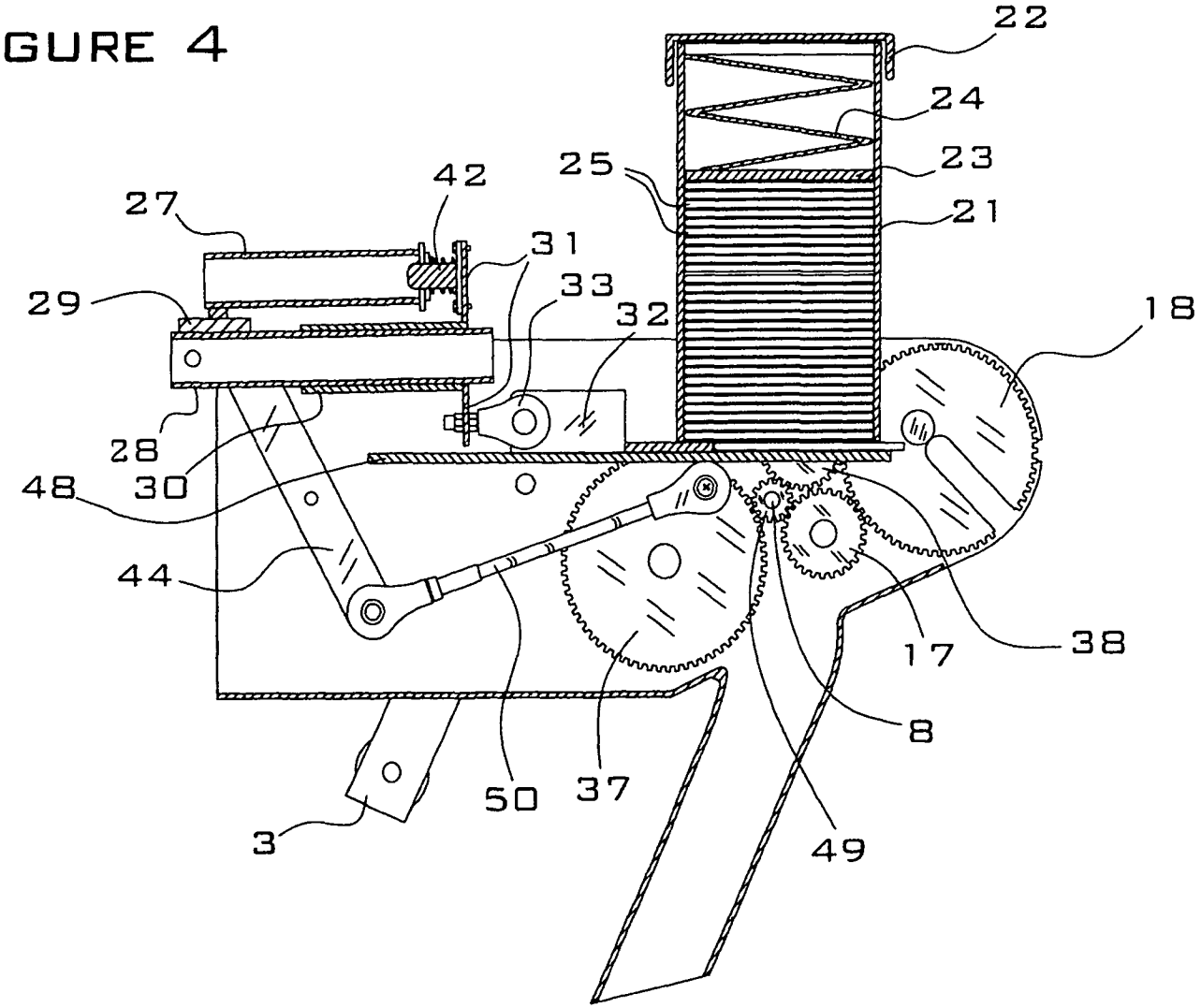
FIG. 4 is a cross-section elevation view of the left side of present invention.
Figure 5A:
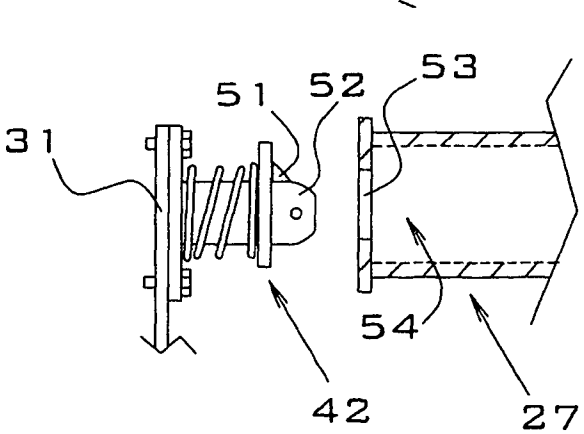
FIG. 5 A is a detail right side elevation view of the pin latch, a portion of the upper tube, and a portion of the pin latch support plate, showing the upper tube disconnected from the pin latch and moving in the forward direction toward the pin latch.
Figure 5B:
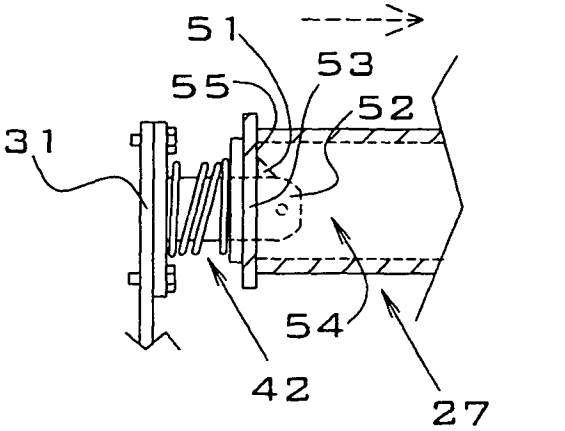
Figure 5C:
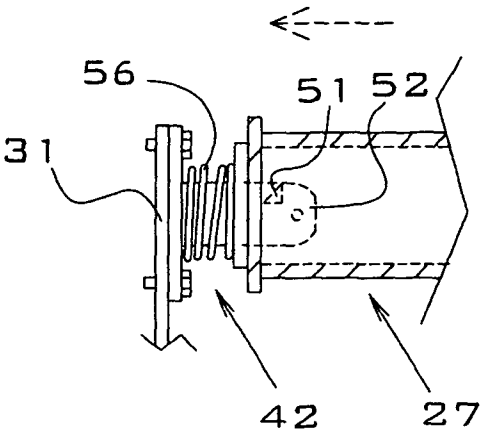
Figure 5D:
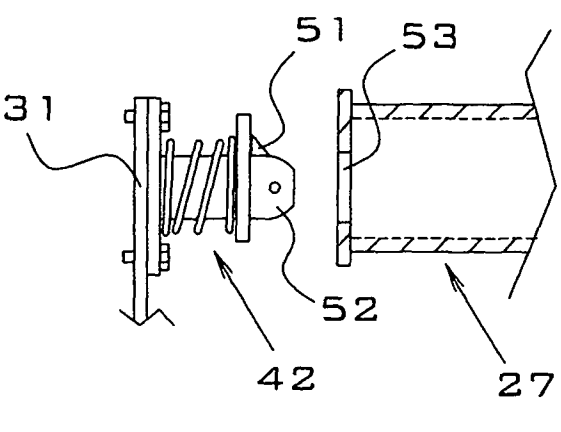

FIG. 1 is an isometric view of the present invention showing the top and exterior right side of the invention. The frame 1 of the present invention comprises a solid horizontal bottom, solid left and right vertical sides, and an open front, rear, and top. Although the rear and top are shown as open in the figures, the rear and top may be enclosed by a cover; the front end must be open, however, to accept the T-post and fence. The frame 1 comprises a support handle 2 that is generally cylindrically shaped and which is rigidly attached to and protrudes from the bottom of the frame 1 at a rearward sloping angle. An operating handle 3 is rotatably attached to the right side 4 of the frame and rigidly attached to the right end of a first sprocket shaft 5 that is positioned in the frame 1 in a direction perpendicular to the right side 4 and the left side 6 of the frame 1, and extends through the left side 6 of the frame, as shown in FIG. 2. The frame 1 comprises a T-post alignment unit 7 that is used to correctly position a T-post against the present invention when a fence wire is being attached to the T-post with a clip, as shown in FIG. 2. In the following drawings and descriptions, the forward end of the present invention is defined as the end of the device closest to the T-post alignment unit 7. A second sprocket shaft 8 and retaining nut 9 are attached to the right side 4 of the frame forward of the first sprocket shaft 5. The second sprocket shaft 8 is positioned in the frame 1 in a direction perpendicular to the right side 4 and the left side 6, and it extends through the left side 6 of the frame, as shown in FIG. 2. A first right gear 10, a second right gear 11, a third right gear 12 and a fourth right gear 13 are rotatably attached to the frame 1 through holes installed through the right side 4 of the frame, and are held in place with circlips 14 that fit into axial grooves installed around the shafts (commonly referred to as the "hubs") of the first through fourth right gears 10 through 13. The hubs of the first through fourth right gears 10 through 13 are visible in FIG. 1 extending through the right side 4 of the frame, while the heads (i.e., the toothed portions) of these gears are positioned against and parallel to the interior surface of the right side 4 of the frame, as shown in FIG. 3. The fourth right gear 13 comprises a radial slot 15 that extends from the perimeter to a point slightly beyond the centerline, as shown. The right and left sides 4 and 6 of the frame 4 each comprise a horizontal slot 16 that is installed in the forward edge of the frame 1. The present invention is bilaterally symmetrical with respect to the first through fourth right gears 10-13; in other words, there is an identical set of first through fourth left gears that are mounted on the interior of the left side 6 of the frame, as shown in FIG. 4. The heads of the third left gear 17 and the fourth left gear 18 are shown in FIG. 1. The fourth left gear 18 comprises a radial slot 15 and a left clip winding post 19, wherein the left clip winding post 19 is cylindrical in shape and has a longitudinal axis that extends perpendicularly from the flat face of the head of the fourth left gear 18 at a point slightly off of the centerline of the fourth left gear 18. The present invention incorporates a clip storage magazine 20 which is rigidly attached to the top of the frame by welding or machine screws. The clip storage magazine 20 is mounted with its vertical axis perpendicular to the longitudinal axis of the frame, and comprises a body 21, a top 22, a magazine follower 23, and a magazine spring 24 (shown in FIG. 3). The clip storage magazine 20 is shown partially loaded with a stack of new clips 25. The present invention further comprises a tube assembly 26 that is moveably mounted to internal components within the frame 1 as described in more detail in reference to FIGS. 7 A through 7 H. The tube assembly 26 comprises an upper tube 27 and a lower internal tube 28 that are rigidly attached to each other and rotationally attached to a tube connection plate 29, and a lower external tube 30 into which the lower internal tube 28 telescopically and slidably fits, and a pin latch support plate 31 which is rigidly mounted to the front end of the lower external tube 30, with the plane of the pin latch support plate 31 perpendicular to the longitudinal axis of the lower external tube 30. The pin latch support plate 31 is rotationally connected to a presenter 32 via a first left connecting rod 33 and a first right connecting rod 34 (shown in FIG. 3). In a preferred embodiment, all of the components of the present invention are fabricated from metal such as steel or aluminum. Alternately, the frame may be constructed from polymer, such as injection-molded high density polyethylene.

FIG. 2 is a left side elevation view of the present invention showing the gears mounted on the exterior left side of the frame, with the present invention shown with the T-post alignment unit 7 positioned against a T-post 35 (shown in phantom) and a horizontal fence wire 36. FIG. 2 shows the hubs of the first left gear 37, the second left gear 38, the third left gear 17 and the fourth left gear 18, which are rotatably attached in holes that are installed into the left side 6 of the frame, and held in place with circlips 14, in an identical manner as described in reference to FIG. 1 for the first through fourth right gears 10-13. Also shown are the support handle 2, the operating handle 3, the clip storage magazine 20 and the tube assembly 26. The radial slot 15 of the fourth loft gear 18 is shown aligned with the horizontal slot 16 in the left side 6 of the frame in this view, allowing the fence wire 36 to be positioned within the slot 15 as shown. A first drive sprocket 39 is attached to the left end of the first sprocket shaft 5, whose right end, as previously described, is connected to the operating handle 3. The first drive sprocket 39 is rotatably connected by a drive chain 40 to a second drive sprocket 41, thereby causing the second drive sprocket 41 to rotate when the operating handle 3 is rotated by a user. The second drive sprocket 41 is rigidly connected to the left end of the second sprocket shaft 8. The ratio of the number of teeth between the first drive sprocket 39 and the second drive sprocket 41 determines the drive ratio of the present invention, and the drive ratio establishes the number or turns of the operating handle 3 required to perform one complete operating cycle of the present invention. For example, in FIG. 2, the first drive sprocket 39 has 40 teeth, while the second drive sprocket 41 has 20 teeth, resulting in a gear ratio of 2 to 1. In FIG. 2, the tube assembly 26 is shown in a fully rearward position. The pin latch support plate 31 is rigidly attached to a pin latch 42 with a pair of machine screws 43, with the longitudinal axis of the cylindrical pin latch 42 perpendicular to the plane of the pin latch support plate 31. The tube connection plate 29 forms a rigid connection between the upper tube 27 and the lower internal tube 28. The tube connection plate 29 is also rotatably connected to the rearward ends of the left pivot arm 44 and the right pivot arm 45 (shown in FIG. 3).

FIG. 3 is a cross-section elevation view of the right side of the present invention taken at the section line shown in FIG. 1, showing the gears mounted on the interior of the right side 4 of the frame, with the gears and operating handle oriented similarly to the orientations shown in FIG. 1. The second sprocket shaft 8 shown is rigidly connected to a fifth right gear 46 that is positioned in close proximity and parallel to the interior surface of the right side 4 of the frame. The fifth right gear 46 is in mesh with the second right gear 11 and the third right gear 12, which in turn are in mesh with the fourth right gear 13. The fifth right gear 46 is also in mesh with the first right gear 10. A second right connecting rod 47 has its forward end rotatably connected to the first right gear 10, and its rearward end rotatably connected to the forward end of the right pivot arm 45. The rearward end of the right pivot arm 45 is rotatably connected to the right side of the tube connection plate 29. The tube connection plate 29 is rigidly connected to the rear portions of the upper tube 27 and the lower internal tube 28. In the position shown, the forward end of the upper tube 27 is rigidly but removably connected to the pin latch 42, which is rigidly connected to the pin latch support plate 31. The pin latch support plate 31 is rigidly connected to the lower external tube 30, and slidably connected to the lower internal tube 28. The rearward threaded end of a first right connecting rod 34 is rigidly connected perpendicularly to the plane of the pin latch support plate 31, and the forward bearing end of the first right connecting rod 34 is rotatably attached to the presenter 32. The presenter 32 is slidably supported by a fixed clip support plate 48 that is positioned below the presenter 32 and rigidly attached to the left side 4 and the right side 6 (shown in FIG. 2) of the frame. The lower end of the magazine spring 24 is rigidly connected to the top side of the magazine follower 23, while the upper end of the magazine spring 24 is in contact with the magazine top 22, providing a downward force on the stack of clips 25 that are stored in the magazine body 21.

FIG. 4 is a cross-section elevation view of the left side of present invention taken at the longitudinal centerline of the frame, and shown in the same gear orientations as shown in FIG. 3, illustrating the bilateral symmetry of the gear components. As shown, a fifth left gear 49, which is attached to the second sprocket shaft 8, is in mesh with the second left gear 38 and the third left gear 17, which are in turn in mesh with the fourth left gear 18. The fifth left gear 49 is also in mesh with the first left gear 37, which is rotatably attached to the forward end of the second left connecting rod 50. The rearward end of the second left connecting rod 50 is rotatably connected to the forward end of the left pivot arm 44, and the rearward end of the left pivot arm 44 is rotatably connected to the left side of the tube connection plate 29. The tube connection plate 29 is rigidly connected to the rear portions of the upper tube 27 and the lower internal tube 28. In the position shown, the forward end of the upper tube 27 is rigidly but removably connected to the pin latch 42, which is rigidly connected to a pin latch support plate 31. The pin latch support plate 31 is rigidly connected to the lower external tube 30, and slidably connected to the lower internal tube 28. The rearward threaded end of the first left connecting rod 33 is rigidly and perpendicularly connected to the plane of the pin latch support plate 31, and the forward bearing end of the first left connecting rod 33 is rotatably attached to the presenter 32. The presenter 32 is slidably supported by the fixed clip support plate 48 that is positioned below the presenter 32 and is rigidly attached to the left side 6 and the right side 4 (shown in FIG. 3) of the frame.

The pin latch 42 is preferably a commercially available component (A4 pin latch assembly, Southco.com, part number A4-20-501-10). The function of the pin latch is to cause the upper tube 27 to pull the presenter 32 (shown in FIGS. 3 and 4) in a rearward direction on every second rearward cycle of the upper tube 27, and to allow the presenter 32 to remain in a forward position on the other alternate rearward cycles of the upper tube 27. The operation of the pin latch 42 is described in reference to FIGS. 5 A through 5 D, which are detail right side elevation views of the pin latch 42, a portion of the upper tube 27, and portion of the pin latch support plate 31, with the internal walls of the upper tube 27 shown in phantom. In FIG. 5 A, the upper tube 27 is disconnected from the pin latch 42, and is moving toward the stationary pin latch 42 in the forward (leftward) direction, as indicated by the dashed arrow. The pin latch 42 comprises an extension tab 51 that retracts inside the body of the pin latch 42 as the head 52 of the pin latch is pushed through an orifice 53 of the upper tube 27, and then the extension tab 51 re-extends under spring pressure as the head 52 of the pin latch passes through the orifice 53 and enters the hollow interior portion 54 of the upper tube 27.

In FIG. 5 B, the head 52 of the pin latch has passed through the orifice 53 of the upper tube, while the upper tube 27 has reversed direction and is moving toward the right, and the extension tab 51 of the pin latch has re-extended and contacted an inner wall 55 of the forward end of the upper tube 27. As the upper tube 27 moves toward the right, the pin latch 42, being held in contact with the upper tube 27 by its extension tab 51, is also pulled toward the right by the movement of the upper tube 27.

In FIG. 5 C, the upper tube 27 has reversed direction again and is moving toward the left. The leftward movement of the upper tube 27 has pushed the pin latch 42 and the attached pin latch support plate 31 in a leftward direction until the pin latch connector plate 31 has reached its maximum limit of leftward travel. At this point, the upper tube 27 continues to move an additional short distance in the leftward direction, while the pin latch 42 is stationary, thereby compressing the coil spring 56 of the pin latch, and forcing the head 52 of the pin latch deeper into the upper tube 27, which causes the extension tab 51 to retract inside the body of the pin latch 42. In this retracted position of the extension tab 51, the pin latch 42 will detach from the upper tube 27 when the upper tube 27 reverses direction and moves in a rightward direction.

In FIG. 5 D, the upper tube 27 is moving toward the right, and has disconnected from the pin latch 42. As shown, after the head 52 of the pin latch 42 exits from the orifice 53 of the upper tube, the extension tab 51 moves into a re-extended position, and the system is reset for the next repetitive cycle.

Figures 6A, 6B:
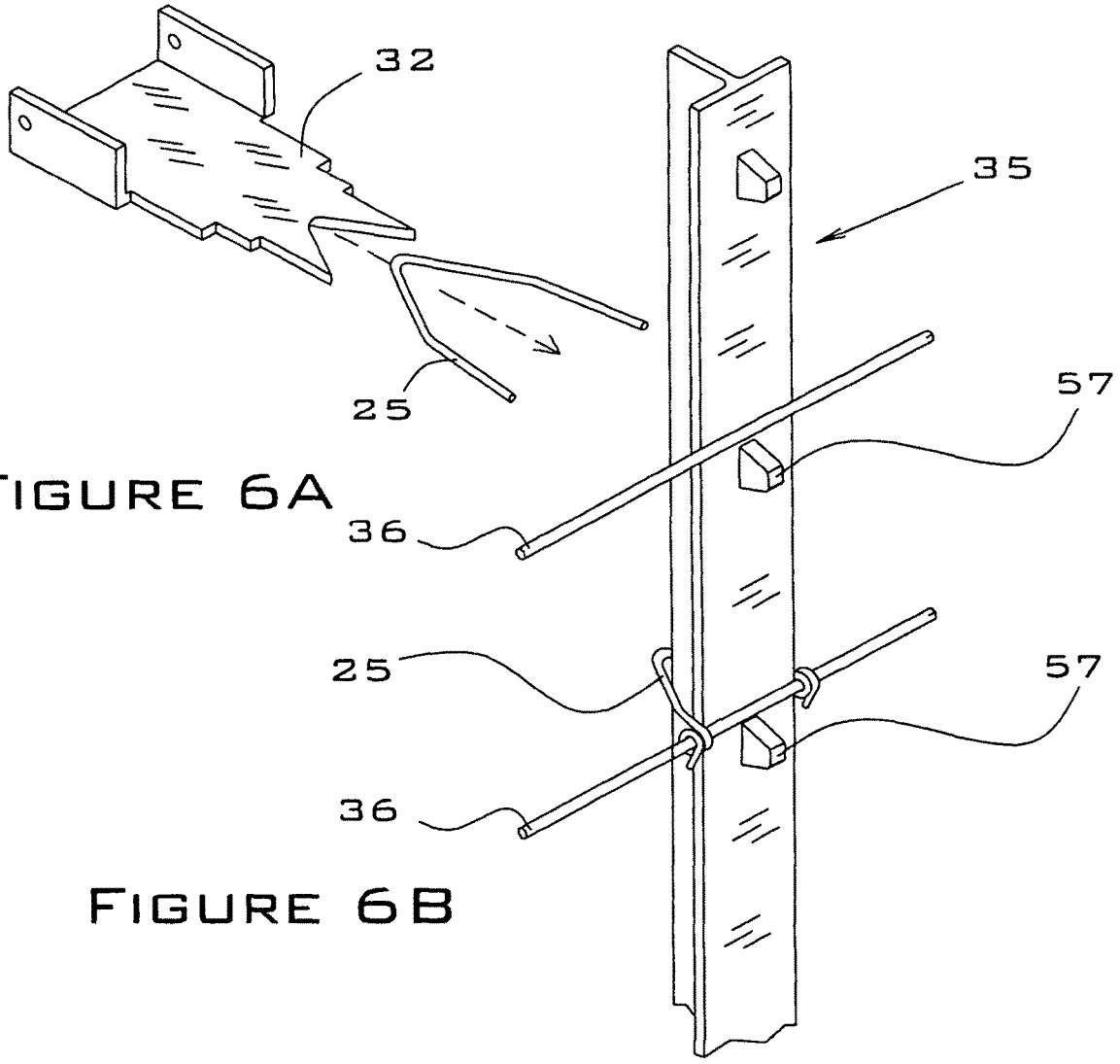
FIG. 6A is an isometric view of the presenter, a T-post, and a horizontal fence wire before the fence wire has been attached to the T-post by a clip that has been installed by the present invention.
Figure 7A:
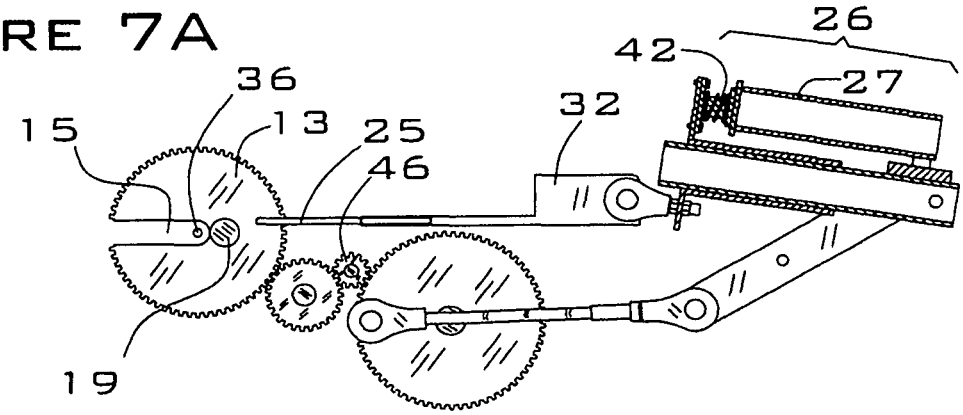
FIG. 7 A illustrates the present invention at the starting position of an operating cycle, with the radial slot of the fourth right gear positioned in a horizontal orientation.
FIG. 7B illustrates the present invention in a first intermediate position of an operating cycle, with the fourth right gear rotated counterclockwise 90°.
Figure 7B:
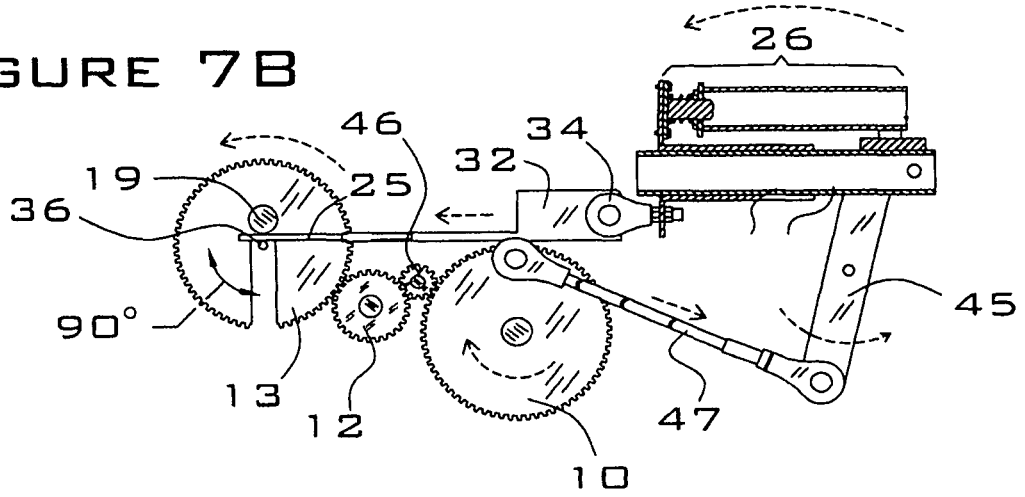
Figure 7C:
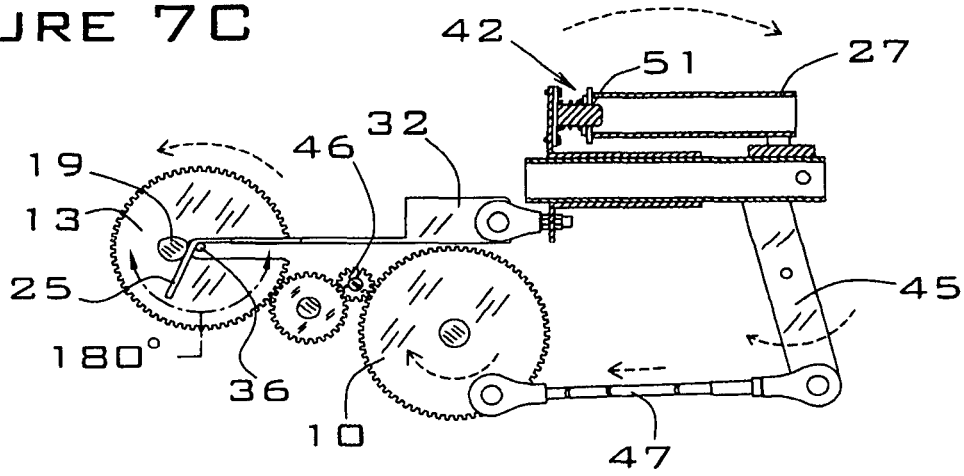
Figure 7D:
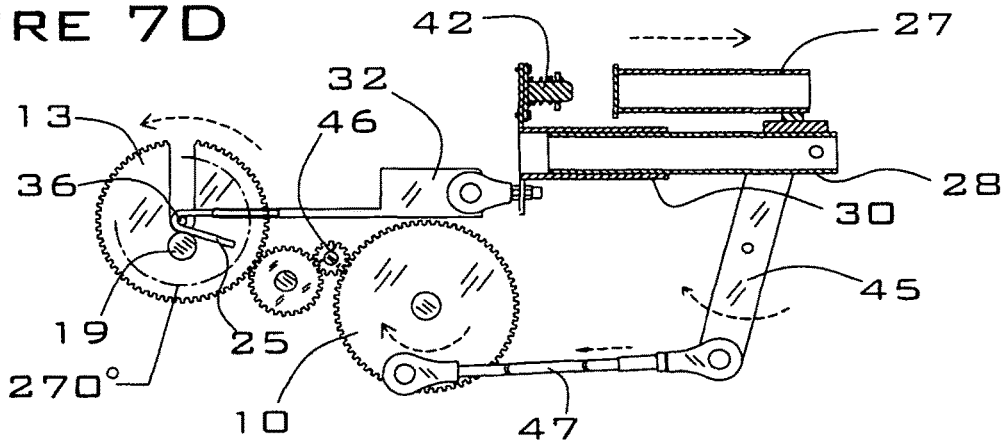
Figure 7E:
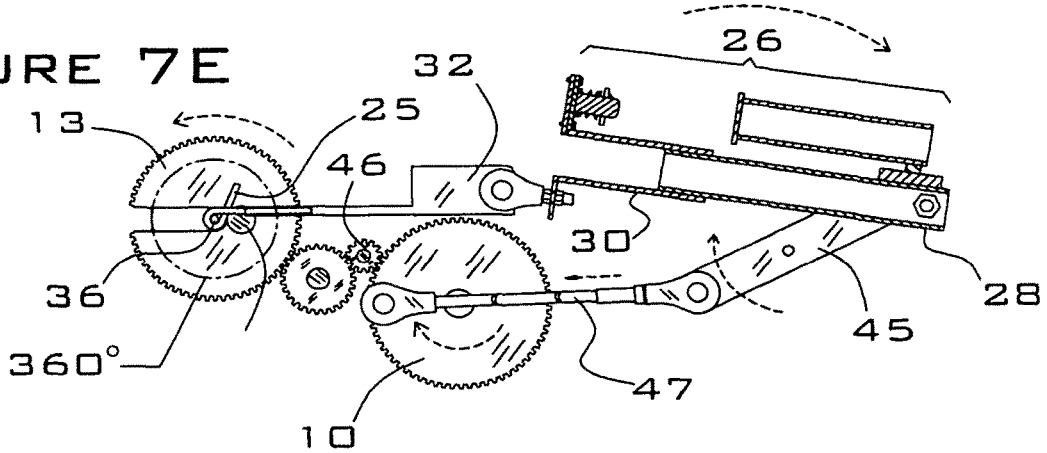
Figure 7F:
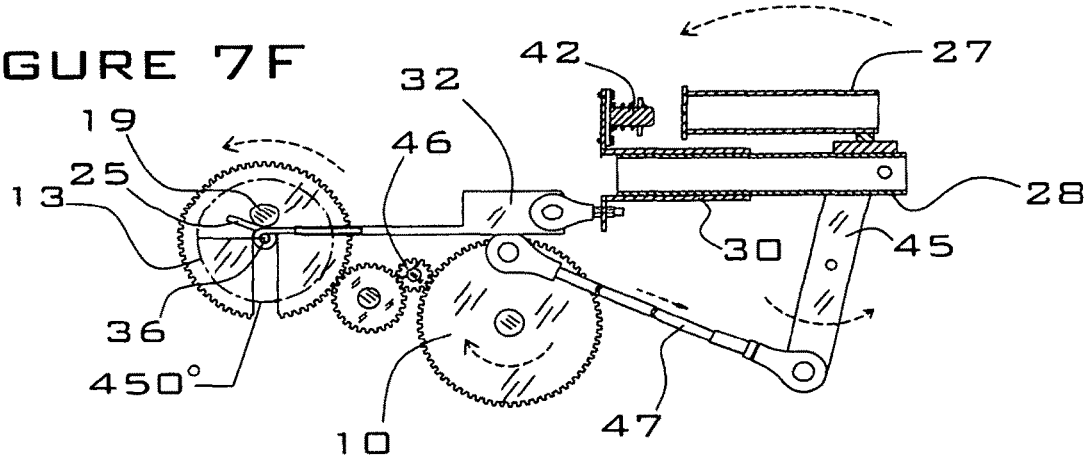
Figure 7G:
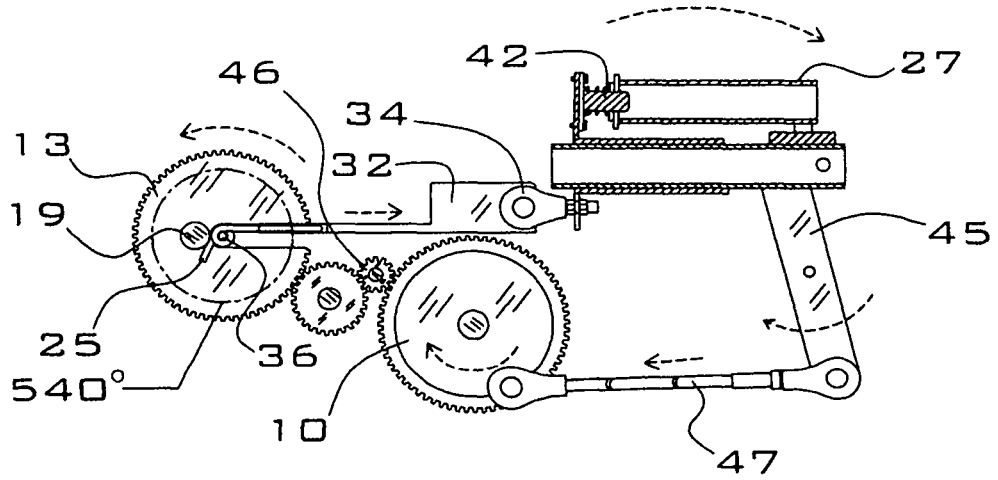
Figure 7H:
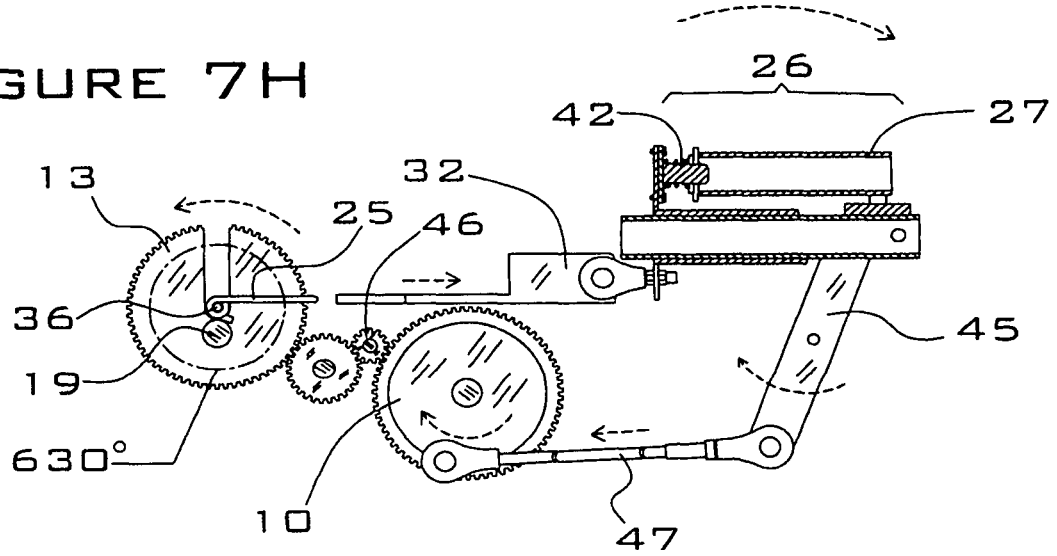

FIGS. 6 A and 6 B are isometric views of a T-post 35 and a horizontal fence wire 36 before and after the fence wire 36 has been attached to the T-post 35 by a clip 25 that has been installed by the present invention. FIG. 6 A shows the presenter 32 and a clip 25, illustrating how the shape of the forward edge of the presenter 32 mates with the shape of the central V section of the clip 25 when the clip is being stripped from the clip storage magazine and pushed against a T-post. The clips 25 used by the present invention are preferably of custom manufacture, and are made from a single piece of bent metal wire having a central apex and two identical leg portions. The clips 25 preferably have a wire diameter of about 7⁄64 inch, a length from the apex to the ends of the legs of about 2⅞ inch, and a maximum width of about 2½ inches across the ends of the legs. The clips have a shape in which the width between the two legs increases toward their ends. FIG. 6 A also shows a fence wire 36 properly positioned on a T-post 35 just above one of the T-post protrusions 57 that are manufactured into standard T-posts, prior to the fence wire 36 being attached to the T-post by a clip 25. FIG. 6 B shows a fence wire 36 attached to the T-post 35 with a clip 25 that has been installed by the present invention. As shown, one leg of the clip 25 is wrapped around the fence wire 36 on each side of the T-post, with the fence wire positioned on top of one of the protrusions 57.

One complete cycle of the present invention involves two distinct types of motions, as follows:

1) Linear Motion: Rotation of the operating handle 3 is converted to linear motion of the presenter 32, which causes the presenter 32 to strip a clip 25 from the clip storage magazine 20 and push the clip 25 in a forward direction, until the clip 25 is forcibly held against a vertical T-post 35. At this time, the two legs of the clip 25 extend beyond a horizontal fence wire 36 which has been positioned against the T-post.

2) Rotational Motion: After the clip 25 has been positioned in accordance with Stage 1 above, rotation of the operating handle 3 causes the fourth right gear 13 and the fourth left gear 18 to wind the two ends of the clip 25 around the fence wire 36, which thereby attaches the fence wire 36 to the T-post 35.

FIGS. 7 A through 7 H are simplified right side cross-section elevation views of the present invention that illustrate eight sequential steps that occur during one complete cycle of operation, which occurs when the present invention installs one clip 25 around a T-post 35 and fence wire 36. For clarity, these figures show only the right side of a clip 25 being wrapped around a fence wire 36 by the right-side components of the present invention. The left side of the clip (not shown) is simultaneously wound around the fence wire 36 by the left-side components of the present invention in an identical manner to the right side. Heavy dashed arrows indicate directional movement of the various components. In these views, the frame 1, clip supply magazine 20, second right gear 11, the clip support plate 48, the T-post alignment unit 7, and the T-post 35 have been removed for clarity.

FIG. 7 A illustrates the present invention at the starting position of an operating cycle. As shown, the radial slot 15 of the fourth right gear 13 is positioned in a horizontal orientation, and a fence wire 36 has been inserted into the radial slot 15. The clip winding post 19 of the fourth right gear 13 is at a 3 o'clock position relative to the axis of the fourth right gear 13. The tube assembly 26 is positioned at the right extent of travel (fully rearward), and a clip 25 is positioned directly in front of and in line with the presenter 32. The pin latch 42 is engaged with the upper tube 27, causing the presenter 32 to be pulled into the fully rearward position.

In FIG. 7 B, the fifth right gear 46 has been rotated (by a user turning the operating handle 3 shown in FIG. 1) so that the fourth right gear 13 has been caused to rotate counterclockwise 90°, placing the clip winding post 19 at a 12 o'clock position. At this point, the rotation of the fifth right gear 46 has also caused a rotation of the first right gear 10, which has caused the second right connecting rod 47 to push against the right pivot arm 45, thereby causing the right pivot arm 45 to rotate in a counterclockwise direction, which causes the tube assembly 26 to rotate in a counterclockwise direction. The counterclockwise movement of the tube assembly 26 pushes the first right connector rod 34 forward, and this movement pushes the presenter 32 forward against the clip 25, thereby moving the clip 25 in a forward direction. At this point in the cycle, the clip 25 has been positioned over the top of the fence wire 36. The end of the clip 25 is also positioned directly below and slightly forward of the clip winding post 19 of the fourth right gear 13, but the clip 25 has not yet started to wind around the fence wire 36.

In FIG. 7 C, the fifth right gear 46 has rotated sufficiently to rotate the fourth right gear 13 180°, placing the clip winding post 19 in a 9 o'clock position. The rotation of the fifth right gear 46 has also caused the first right gear 10 to rotate so that the second right connecting rod 47 is being pulled in a forward direction. The forward movement of the second right connecting rod 47 causes the right pivot arm 45 to reverse direction and start to rotate in a clockwise direction. The extension tab 51 of the pin latch (shown more clearly in FIG. 5 C) has been retracted, and the pin latch 42 has started to pull out of the upper tube 27, as the upper tube 27 begins to rotate in a clockwise direction. The presenter 32 has pushed the clip 25 fully forward against the T-post (shown in FIG. 2). The presenter 32 remains in a fully forward position since the extension tab 51 has been retracted and the pin latch 42 is not being pulled by the upper tube 27. At this point in the operating cycle, the rotation of the clip winding post 19 has caused the clip 25 to wind around the fence wire 36 about ⅛ of a revolution.

In FIG. 7 D, rotation of the fifth right gear 46 has caused the fourth right gear 13 to rotate 270°, placing the clip winding post 19 in a 6 o'clock position. The rotation of the fifth right gear 46 has also caused the first right gear 10 to continue to pull the second right connector rod 47 along in a forward direction, thereby continuing to rotate the right pivot arm 45 in a clockwise position, which causes the upper tube 27 to fully separate from the pin latch 42 and continue to move in a clockwise direction, while the lower internal tube 28, which is also moving in a clockwise direction, begins to slide rearward relative to the lower external tube 30. The presenter 32 remains in a fully forward position. At this point in the cycle, the clip winding post 19 has rotated sufficiently to wind the clip 25 around the fence wire 36 slightly less than ½ of a revolution.

In FIG. 7 E, rotation of the fifth right gear 46 has caused the fourth right gear 13 to rotate 360° and the clip winding post 19 to be in a 3 o'clock position. Rotation of the fifth right gear 46 has also caused the first right gear 10 to rotate sufficiently so that the second right connector rod 47 has been pulled to almost at its limit of forward travel, which has continued to rotate the right pivot arm 45 in a clockwise direction, thereby causing the tube assembly 26 to be rotated into almost its fully rearward position. The lower internal tube 28 has moved almost fully rearward relative to the lower external tube 30. The presenter 32 remains in a fully forward position. The clip winding post 19 has rotated sufficiently so that the clip 25 has been wound slightly less than ¾ of a revolution around the fence wire 36.

In FIG. 7 F, the fifth right gear 46 has rotated sufficiently so that fourth right gear 13 has rotated 450°, and the winding post 19 is in a 12 o'clock position. Rotation of the fifth right gear 46 has also rotated the first right gear 10 sufficiently so that the second right connector rod 47 is being pushed in a rearward direction. This movement causes the right pivot arm 45 to reverse direction and rotate in a counterclockwise direction, which causes the upper tube 27 to also move in a counterclockwise direction toward the pin latch 42, and causes the lower internal tube 28 to slide forward within the lower external tube 30. The presenter 32 remains in a fully forward position. The clip winding post 19 has wound the clip 25 slightly less than one full revolution around the fence wire 36.

In FIG. 7 G, the fifth right gear 46 has rotated sufficiently so that fourth right gear 13 has rotated 540° and the winding post 19 is in a 9 o'clock position. Rotation of the fifth right gear 46 has also caused the first right gear 10 to rotate sufficiently so that the second right connecting rod 47 is being pulled in the forward direction, thereby causing the right pivot arm 45 to reverse direction and rotate in a clockwise direction. The upper tube 27 has connected to the pin latch 42, has begun to rotate clockwise, and is starting to pull the pin latch 42, the pin latch support plate 31, the right first connector rod 34, and the presenter 32 in the rearward direction. The clip winding post 19 has wound the clip 25 approximately 1⅛ revolutions around the fence wire 36.

In FIG. 7 H, the fifth right gear 46 has rotated sufficiently so that the fourth right gear 13 has been rotated 630°, and the clip winding post 19 is in a 6 o'clock position. Rotation of the fifth right gear 46 has also caused the first right gear 10 to continue to rotate, so that the second right connector rod 47 has continued to move in the forward direction, thereby continuing the clockwise rotation of the right pivot arm 45 and the tube assembly 26, which causes the first right connector rod 34 to pull the presenter 32 in a rearward direction so that it is no longer in contact with the clip 25. The clip winding post 19 has wound the clip 25 approximately 1¼ to 1½ revolutions around the fence wire 36. At this point, the clip 25 has been fully installed around the fence wire 36 and the T-post 35 (shown in FIG. 2), and the present invention may be pulled away from the T-post 35. The operating cycle is completed by continuing to turn the operating handle 3 (shown in FIG. 1) until the fourth right gear 13 has rotated an additional 90°, for a total rotation of 720°, or two complete revolutions. At this point in the cycle, the present invention has returned to the position illustrated in FIG. 7 A.

In an alternate embodiment, the manual operating handle, first drive sprocket, second drive sprocket, drive chain, and first sprocket shaft may be replaced by a battery-powered electric motor, which may be configured so as to fit within the frame 1 and so as to provide rotational power to the second sprocket shaft 8. Batteries for the motor may be positioned within the frame or, optionally, within the support handle. The motor may be equipped with controllers to automatically control its start and stop timing. Optionally, the right side 4 and the left side 6 of the frame may be extended upward and rearward so as to provide side covers for the tube assembly 26.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A handheld tool for installing wire on a fence comprising:

(a) a frame having a horizontal bottom, a first vertical side, and a second vertical side;

(b) a sprocket system that is situated at least partially within the frame and engaged by an actuator;

(c) a T-post alignment unit that is configured to position a vertical T-post against the tool;

(d) a clip storage magazine that is attached to a top of the frame and mounted with its vertical axis perpendicular to a longitudinal axis of the frame;

(e) a tube assembly that is movably mounted within the frame; and (f) a presenter that is configured to present clips from the magazine;

wherein the sprocket system and tube assembly are configured to cause the clip presented by the presenter to be pushed into position against the T-post and a horizontal fence wire, tension the fence wire against the T-post, lock the fence wire into position against the T-post by straddling the T-post with the clip, and wrap two ends of the clip around the fence wire to attach it to the T-post;

wherein the sprocket system comprises a first sprocket shaft that is positioned within the frame in a direction that is perpendicular to and extends through the first and second vertical sides of the frame;

wherein the first sprocket shaft is mechanically coupled to a first drive sprocket;

wherein the first drive sprocket is rotatably connected to a second drive sprocket via a drive chain;

wherein the second drive sprocket is mechanically coupled to a second sprocket shaft;

wherein the sprocket system further comprises a first right gear, a second right gear, a third right gear, and a fourth right gear that are rotatably attached to the first vertical side of the frame;

wherein each of the first right gear, second right gear, third right gear and fourth right gear comprises a head that is positioned against and parallel to an interior surface of the first vertical side of the frame;

wherein the fourth right gear comprises a radial slot that extends from a perimeter of the fourth right gear to a point at or slightly beyond a centerline of the head of the fourth right gear;

wherein the sprocket system further comprises a first left gear, a second left gear, a third left gear, and a fourth left gear that are rotatably attached to the second vertical side of the frame;

wherein each of the first left scar, second left gear, third left gear and fourth left gear comprises a head that is positioned against and parallel to an interior surface of the second vertical side of the frame;

wherein the fourth left gear comprises a radial slot that extends from a perimeter of the fourth left gear to a point at or slightly beyond a centerline of the head of the fourth left gear;

wherein the first vertical side and second vertical side of the frame each comprises a horizontal slot that is installed in a forward edge of the frame; and wherein the horizontal slots in the first and second vertical sides of the frame are configured to be aligned with the radial slots in the fourth right gear and fourth left gear when the fourth right gear and fourth left gear are rotated to a particular position;

wherein the fourth right gear comprises a clip winding post situated rearward of the radial slot in the fourth right gear when the radial slot of the fourth right gear is aligned with the horizontal slot in the first vertical side of the frame;

wherein the clip winding post of the fourth right gear has a longitudinal axis that extends perpendicularly from a flat face of the head of the fourth right gear;

wherein the fourth left gear comprises a clip winding post situated rearward of the radial slot in the fourth left gear when the radial slot of the fourth left gear is aligned with the horizontal slot in the second vertical side of the frame;

wherein the clip winding post of the fourth left gear has a longitudinal axis that extends perpendicularly from a flat face of the head of the fourth left gear;

wherein the sprocket system further comprises a fifth right gear that is attached to the second sprocket shaft and positioned in close proximity and parallel to an interior surface of the first vertical side of the frame;

wherein the fifth right gear is in mesh with the first right gear, the second right gear and the third right gear;

wherein the second right gear and third right gear are in mesh with the fourth right gear;

wherein the sprocket system further comprises a fifth left gear that is attached to the second sprocket shaft and positioned in close proximity and parallel to an interior surface of the second vertical side of the frame;

wherein the fifth left gear is in mesh with the first left gear, the second left gear and the third left gear; and wherein the second left gear and the third left gear are in mesh with the fourth left gear.

2. A handheld tool for installing wire on a fence comprising:

(a) a frame having a horizontal bottom, a first vertical side, and a second vertical side;

(b) a sprocket system that is situated at least partially within the frame and engaged by an actuator;

(c) a T-post alignment unit that is configured to position a vertical T-post against the tool;

(d) a clip storage magazine that is attached to a top of the frame and mounted with its vertical axis perpendicular to a longitudinal axis of the frame;

(e) a tube assembly that is movably mounted within the frame; and (f) a presenter that is configured to present clips from the magazine;

wherein the sprocket system and tube assembly are configured to cause the clip presented by the presenter to be pushed into position against the T-post and a horizontal fence wire, tension the fence wire against the T-post, lock the fence wire into position against the T-post by straddling the T-post with the clip, and wrap two ends of the clip around the fence wire to attach it to the T-post;

wherein a rearward end of a first left connecting rod is connected perpendicularly to a pin latch support plate;

Wherein the first left gear is rotatably attached to a forward end of a second left connecting rod;

wherein a rearward end of the second left connecting rod is rotatably connected to a forward end of a left pivot arm, and a rearward end of the left pivot arm is rotatably connected to a left side of a tube connection plate;

wherein the tube connection plate is connected to rear portions of an upper tube and a lower internal tube; and wherein a forward end of the first left connecting rod is rotatably attached to the presenter.

3. The tool of claim 2, wherein a rearward end of a first right connecting rod is connected perpendicularly to the pin latch support plate;

wherein the first right gear is rotatably attached to a forward end of a second right connecting rod;

wherein a rearward end of the second right connecting rod is rotatably connected to a forward end of a right pivot arm;

wherein a rearward end of the right pivot arm is rotatably connected to a right side of the tube connection plate;

wherein the tube connection plate is connected to rear portions of the upper tube and the lower internal tube; and wherein a forward end of the first right connecting rod is rotatably attached to the presenter.

4. A handheld tool for installing wire on a fence comprising:

(a) a frame having a horizontal bottom, a first vertical side, and a second, vertical side;

(b) a sprocket system that is situated at least partially within the frame and engaged by an actuator;

(c) a T-post alignment unit that is configured to position a vertical T-post against the tool;

(d) a clip storage magazine that is attached to a top of the frame and mounted with its vertical axis perpendicular to a longitudinal axis of the frame;

(e) a tube assembly that is movably mounted within the frame; and (f) a presenter that is configured to present clips from the magazine;

wherein the sprocket system and tube assembly are configured to cause the clip presented by the presenter to be pushed into position against the T-post and a horizontal fence wire, tension the fence wire against the T-post, lock the fence wire into position against the T-post by straddling the T-post with the clip, and wrap two ends of the clip around the fence wire to attach it to the T-post;

wherein the tube assembly comprises:

an upper tube and a lower internal tube that are fixedly attached to each other and rotationally attached to a tube connection plate; and a lower external tube into which the lower internal tube telescopically and slidably fits;

wherein the pin latch support plate is fixedly connected to the lower external tube and slidably connected to the lower internal tube;

wherein the pin latch support plate is rotationally connected to the presenter via a first left connecting rod and a first right connecting rod;

wherein the pin latch support plate is attached to a pin latch;

wherein the tube connection plate forms a mechanical connection between the upper tube and the lower internal tube; and wherein the tube connection plate is rotatably connected to a rearward end of a left pivot arm and a rearward end of a right pivot arm.

5. The handheld tool of claim 4, wherein the clip storage magazine comprises a body, a top, a magazine follower and a magazine spring.

6. The handheld tool of claim 5, wherein the presenter is slidably supported, by a fixed clip support plate that is positioned below the presenter and attached to the first vertical side and left vertical side of the frame; and wherein a lower end of the magazine spring is connected to a top side of the magazine follower, and an upper end of the magazine spring is in contact with the magazine top, the spring being configured to exert a downward force on a stack of clips stored in the magazine body.

* * * * *